US005650084A

United States Patent [19]

Bley

[11] Patent Number: 5,650,084

[45] Date of Patent: Jul. 22, 1997

[54] MICROWAVABLE BAG WITH RELEASABLE SEAL ARRANGEMENT TO INHIBIT SETTLING OF BAG CONTENTS; AND METHOD

[75] Inventor: Michael Eugene Bley, Minneapolis, Minn.

[73] Assignee: Golden Valley Microwave Foods, Inc., Edina, Minn.

[21] Appl. No.: 537,424

[22] Filed: Oct. 2, 1995

[51] Int. Cl.[6] ..... H05B 6/80

[52] U.S. Cl. ..... 219/727; 219/730; 99/DIG. 14; 426/107; 426/113; 426/234

[58] Field of Search ..... 219/727, 730; 99/DIG. 14; 426/107, 109, 111, 113, 234, 243; 383/93, 94, 121; 229/903

[56] References Cited

U.S. PATENT DOCUMENTS

| | | |
|---|---|---|
| 2,041,227 | 5/1936 | Chalmers . |
| 2,149,872 | 3/1939 | Schmidt . |
| 2,628,764 | 2/1953 | Rubinstein et al. . |
| 2,741,559 | 4/1956 | Banowitz . |
| 3,008,835 | 11/1961 | Madding . |
| 3,027,261 | 3/1962 | Samara . |
| 3,035,754 | 5/1962 | Meister . |
| 3,036,616 | 5/1962 | Allen . |
| 3,052,554 | 9/1962 | Colman . |
| 3,207,420 | 9/1965 | Navarrete-Kindelan . |
| 3,286,832 | 11/1966 | Pilger . |
| 3,293,048 | 12/1966 | Kitterman . |
| 3,317,118 | 5/1967 | Harrison et al. . |
| 3,637,132 | 1/1972 | Gray . |
| 3,671,270 | 6/1972 | Jehn . |
| 3,689,291 | 9/1972 | Draper . |
| 3,835,280 | 9/1974 | Gades et al. . |
| 3,851,574 | 12/1974 | Katz et al. . |
| 3,853,612 | 12/1974 | Spanoudis . |
| 3,873,735 | 3/1975 | Chalin et al. . |
| 3,970,241 | 7/1976 | Hanson . |
| 3,973,045 | 8/1976 | Brandberg et al. . |
| 4,038,425 | 7/1977 | Brandberg et al. . |
| 4,190,757 | 2/1980 | Turpin et al. . |
| 4,219,573 | 8/1980 | Borek . |
| 4,230,924 | 10/1980 | Brastad et al. . |
| 4,267,420 | 5/1981 | Brastad . |
| 4,292,332 | 9/1981 | McHam . |
| 4,404,241 | 9/1983 | Mueller . |
| 4,450,180 | 5/1984 | Watkins . |
| 4,461,031 | 7/1984 | Blamer . |
| 4,518,651 | 5/1985 | Wolfe, Jr. . |
| 4,548,826 | 10/1985 | Watkins . |
| 4,553,010 | 11/1985 | Bohrer et al. . |
| 4,571,337 | 2/1986 | Cage et al. . |

(List continued on next page.)

FOREIGN PATENT DOCUMENTS

| | | |
|---|---|---|
| 449465 | 6/1948 | Canada . |
| 692877 | 8/1964 | Canada . |
| 1069861 | 1/1980 | Canada . |
| 81544 | 7/1956 | Denmark . |
| 0 276 654 | 1/1988 | European Pat. Off. . |
| 0 357 008 | 8/1988 | European Pat. Off. . |
| 0 312 333 | 10/1988 | European Pat. Off. . |
| 1786047 | 11/1971 | Germany . |
| 2 202 118 | 9/1988 | United Kingdom . |
| PCT/US93/00849 | 8/1993 | WIPO . |

*Primary Examiner*—Philip H. Leung
*Attorney, Agent, or Firm*—Merchant, Gould, Smith, Edell, Welter & Schmidt, P.A.

[57] ABSTRACT

A folded microwavable arrangement is provided. The arrangement includes a folded bag having an interior, the bag being folded to define a portion of the interior with an upper portion and a lower edge, defined by a transverse folds in the bag. The arrangement also includes a releasable seal arrangement in a portion of the folded bag between the upper portion and the lower edge. The seal arrangement is oriented to inhibit contents in the interior from settling away from the upper portion and toward the lower fold line, when the folded bag is oriented with the upper portion oriented above the lower edge and with contents in the interior. Methods of folding such arrangements and using such arrangements are also provided.

6 Claims, 3 Drawing Sheets

U.S. PATENT DOCUMENTS 4,584,202 4/1986 Roccaforte .
4,604,854 8/1986 Andreas .
4,641,005 2/1987 Seiferth .
4,678,882 7/1987 Bohrer et al. .
4,691,374 9/1987 Watkins et al. .
4,698,472 10/1987 Cox et al. .
4,735,513 4/1988 Watkins et al. .
4,825,024 4/1989 Seaborne .
4,851,246 7/1989 Maxwell et al. .
4,864,090 9/1989 Maxwell et al. .
4,878,765 11/1989 Watkins et al. .
4,904,488 2/1990 LaBaw et al. .
4,943,456 7/1990 Pollart et al. .
4,963,374 10/1990 Brandel et al. ..... 426/107
4,970,358 11/1990 Brandberg et al. .
4,973,810 11/1990 Brauner .
4,982,064 1/1991 Hartman et al. .
5,006,405 4/1991 Watkins et al. .
5,011,299 4/1991 Black, Jr. et al. .
5,044,777 9/1991 Watkins et al. .
5,079,083 1/1992 Watkins et al. .
5,081,330 1/1992 Brandberg et al. .
5,175,031 12/1992 Ochocki .
5,189,272 2/1993 McDonald et al. .
5,195,829 3/1993 Watkins et al. .
5,200,590 4/1993 Bowen et al. .
5,294,765 3/1994 Archibald et al. .
5,302,790 4/1994 Turpin .
5,306,512 4/1994 Blamer .
5,344,661 9/1994 Mendenhall et al. .
5,357,086 10/1994 Turpin et al. .
5,405,663 4/1995 Archibald et al. .
5,461,216 10/1995 McDonald ..... 219/727
5,474,383 12/1995 Zuege et al. ..... 219/727
5,488,220 1/1996 Freerks et al. ..... 219/727

MICROWAVABLE BAG WITH RELEASABLE SEAL ARRANGEMENT TO INHIBIT SETTLING OF BAG CONTENTS; AND METHOD

FIELD OF THE INVENTION

The present invention relates to microwavable packaging for food. In particular, it pertains to arrangements which contain food, to be microwave cooked. The particular embodiment shown concerns arrangements for popping microwavable popcorn.

BACKGROUND OF THE INVENTION

A wide variety microwavable food products are presently known. The ones of particular concern to the present invention are those in which the construction is used to pop microwavable popcorn. In general, the related consumer product is a package which includes a popcorn charge. In use, the package including the unpopped popcorn charge is positioned appropriately in a microwavable oven and is exposed to microwave energy. During the microwave process, the popcorn is popped.

Particular arrangements to which the present invention relate, are those in which the package is a flexible bag or pouch, which expands during the popping process. Expandable bag arrangements are described, for example, in U.S. Pat. Nos. 4,548,826; 4,691,374; 5,081,330; 5,044,777; 5,195,829; and 5,302,790, the disclosures of which are incorporated herein by reference. Each of the patents listed in this paragraph has been assigned to Golden Valley Microwave Foods, Inc. of Edina, Minn., the assignee of the present application.

Referring to U.S. Pat. No. 5,044,777, certain characteristics of desirable conventional microwavable popcorn packaging are apparent. First, the bags are generally provided in a configuration wherein side gussets are used to separate the internal volume of the bag into first and second "tubes". When the arrangement is filled, generally the popcorn charge is placed in one of the two "tubes" and is substantially retained therein, prior to popping. This is shown, for example, in U.S. Pat. No. 5,044,777, FIG. 3.

Also, in general the popcorn charge is positioned in a center portion (typically about one-third) of the arrangement. For many arrangements, during storage the packaging arrangement is folded into a "trifold" configuration. This is apparent from the drawings and descriptions of U.S. Pat. Nos. 4,044,777 and 5,195,829; and it is specifically illustrated in U.S. Pat. No. 4,548,826, FIG. 5, and U.S. Pat. No. 4,691,374, FIGS. 3A and 14.

In some instances, it has been found that the positioning of the popcorn charge substantially in one of two tubes, and substantially only in a central portion of that tube, especially in association with a microwave interactive material or susceptor positioned in close proximity, leads to preferred characteristics of popping. This is referenced generally in the patents identified above, and specifically in connection with U.S. Pat. Nos. 4,548,826 and 4,691,374. Herein when it is said that the popcorn charge is "substantially only" in a location, it is meant that preferably at least 80% and more preferably at least 90–95% by weight, (and most preferably essentially all) of the charge (popcorn, fat, etc.) is at the stated location.

The present invention relates to improvements in conventional microwave popcorn packaging.

SUMMARY OF THE INVENTION

According to at least one aspect of the present invention, a folded microwavable arrangement is provided. The folded microwavable arrangement generally comprises a folded bag having an interior. The bag is folded to define a portion of the interior with an upper portion and a lower edge. In a typical arrangement, the upper portion and lower edge are defined by transverse folds in the folded bag, although such is not required. In addition, the arrangement includes a releasable seal arrangement in a portion of the folded bag between the upper portion and the lower edge. The releasable seal arrangement is oriented to inhibit or reduce settling of contents in the interior in a direction away from the upper portion and toward the lower fold line; the inhibition to settling being present when the folded bag is oriented with the upper edge positioned above or higher than the lower edge and with settleable contents in the interior.

In preferred arrangements, a microwave interactive construction is provided in thermoconductive contact with at least a portion of the interior between the upper portion and the lower edge of the folded bag. By "thermoconductive contact" in this context, it is meant that the construction is oriented so that heat generated by it, in use, will at least in part be transferred to the vicinity of the contents in the bag, in the region identified. Preferred microwave interactive constructions include conventional ones with a sheet of polymeric material with a layer of metal thereon.

Preferably the releasible seal arrangement comprises first and second heat seals with a gap therebetween. Preferably the first heat seal extends generally diagonally downwardly, when the arrangement is oriented with the upper portion above the lower edge; and the second heat seal also extends generally diagonally downwardly, when the arrangement is oriented with the upper portion above the lower edge. Also preferably the first and second heat seals extend diagonally downwardly toward one another, when the arrangement is so oriented.

Herein when it is said that a seal is "releasable", it is meant that the seal is such that it will release when the arrangement is used in a microwave oven, in the manner generally intended. For example, if the construction is one used for the popping of microwave popcorn, a "releasable" seal is one which, as the arrangement expands under the influence of heat and steam generated during the popping process, releases or opens. Releasable seals are widely utilized in the microwave industry, in a variety of manners.

One preferred construction is that in which the folded bag comprises a trifold, when stored. In some constructions the trifold will be stored in a moisture barrier, to enhance the shelf life of the contents. Alternatively, the arrangement may be a bifold, flat bottom bag or a variety of alternate constructions. The general characteristic is that the arrangement comprises a flexible folded bag, wherein the fold lines define an upper portion and a lower edge, and a seal arrangement according to the present invention is utilized to inhibit settling of contents in a direction from the upper portion toward the lower edge.

The contents of certain folded arrangements according to the present invention generally include a charge of microwavable popcorn. In some instances, the charge of microwavable popcorn may include additives such as an added oil/fat. Flavorants, for example salt, may be used in popcorn charges of arrangements according to the present invention, as well as other adjuvants such as dyes.

According to the present invention, methods for storing popcorn, for example through the utilization of arrangements described, are also provided. In addition, flexible sheet constructions which can be configured as a folded microwavable arrangement as described are provided. Also, arrangements which comprise unfolded bags that can be filled and folded, to form an arrangement as described, are provided.

DETAILED DESCRIPTION

Problems with Some Conventional Systems

The present invention relates to improvements in conventional microwave packaging constructions, such as those described in the incorporated references. Such conventional arrangements generally involve a collapsed package, having a microwave interactive sheet or susceptor operably positioned therein, and with a microwavable popcorn charge positioned in a covering relation or thermoconductive relation to the microwave interactive construction. For many conventional arrangements, the package is generally oriented in a trifold orientation during storage and prior to use. The trifold is typically positioned in a moisture barrier or overwrap to enhance the shelf life of the contents.

It is sometimes desirable to store or display the folded package in a more or less vertical orientation. When this is done, the popcorn charge may tend to settle or shift toward the bottom of the standing (folded) package. As the popcorn charge settles (or shifts), it tends to leave portions of the bag, where the microwave interactive material or susceptor is located, uncovered by the popcorn charge.

When conventional arrangements which have been vertically stored prior to use are then unfolded and placed in a microwave oven for popping of the popcorn charge, less consistent and/or less desireable operation is sometimes observed. In addition, it has been observed that the portions of the bag construction where the microwavable interactive material is positioned appear to undergo greater amounts of undesirable disintegration or decomposition.

In connection with the development of the present invention, it has been theorized that the settling of the popcorn during the vertical storage is related to the observation of less consistent/desireable operation. It is believed that uncovering of portions of the bag where the microwave interactive material is located, especially uncovering it by shifting the popcorn charge, may relate to an enhanced rate of disintegration of the microwave interactive material during use. Also, since the popcorn charge is not distributed as evenly over the microwave interactive material, as a result of the shifting or settling, the popcorn may not as readily receive the benefits of the heat generated by the microwave interactive material during the microwave cooking process.

The present invention relates to improvements in microwave popcorn packaging, so that vertical storage of folded arrangements with less settling of the popcorn charge, can be accomplished.

The Preferred Arrangements of FIGS. 1–5

Figure 1:
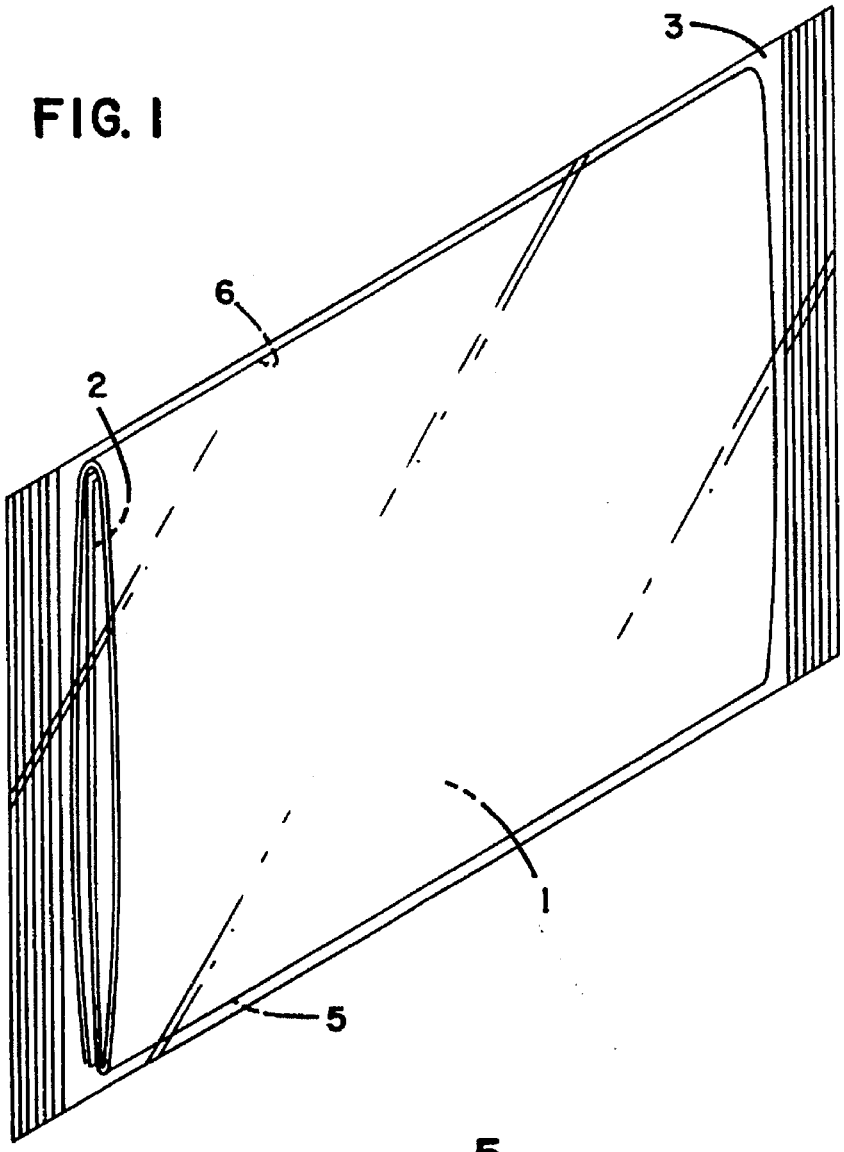
FIG. 1 is a front perspective view of an arrangement according to one embodiment of the present invention; the arrangement of FIG. 1 being depicted enclosed in a storage overwrap and oriented standing on an edge.

The reference numeral 1, FIG. 1, depicts a microwavable popcorn package according to the present invention. In FIG. 1, the popcorn package 1 is depicted in a conventional "trifold" configuration 2, for storage. In FIG. 1, the trifold 2 is sealed within overwrap 3.

In FIG. 1, popcorn package 1 is depicted stored or oriented substantially vertically. Thus, if arrangement 1 were conventional, the popcorn charge positioned inside popcorn package 1 (not viewable in FIG. 1) would tend to shift or settle in a direction from upper portion or edge 6 toward bottom edge 5. This could leave portions of the inside of the bag 1 where the microwave interactive material is located, especially those portions near upper edge 6 of the trifold configuration 2, exposed, i.e. not covered by or in contact with the popcorn charge, even after overwrap 3 is removed and popcorn package 1 is unfolded and oriented in microwave oven for cooking, in a conventional manner.

The present invention relates to the utilization of an arrangement to inhibit or reduce settling of the enclosed popcorn charge (for example, toward edge 5, FIG. 2) when a folded popcorn package 1 such as that shown in FIG. 1, is stored upright, for example in a vertical orientation. For the particular embodiments described herein, an internal temporary or releasable seal is used between selected portions of the arrangement, to inhibit/reduce the undesirable settling.

It is noted that the arrangements depicted in the drawings are "trifolds", and the invention is described and depicted in connection with such arrangements. It will be apparent, however, that the techniques according to the present invention can be utilized to inhibit settling in other folded arrangements, even when those arrangements are not "trifolds".

Figure 2:
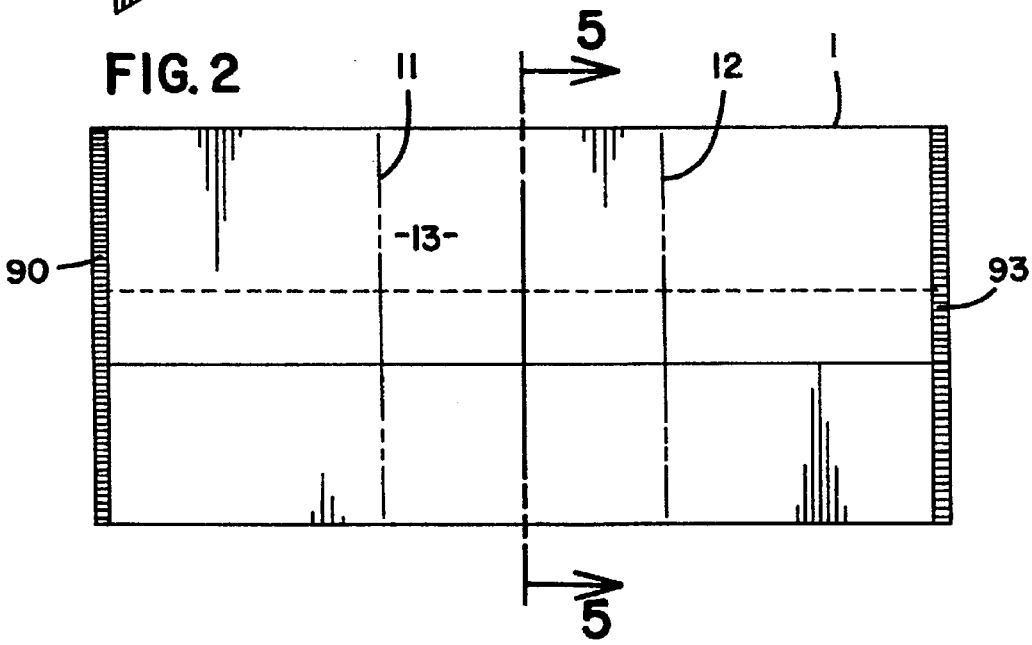
FIG. 2 is a schematic top plan view of an arrangement according to FIG. 1, depicted unwrapped and unfolded, as it would be when positioned in a microwave oven for cooking.

In FIG. 2, a top plan view, popcorn package 1 is schematically shown in an unfolded configuration and oriented much as it would be when positioned in a microwave oven for popping of the popcorn charge, but before expansion. In FIG. 2, lines 11 and 12 indicate fold lines which define central region 13 in the arrangement. In central region 13, the unpopped popcorn charge will generally be positioned in an orientation above a portion of the bag in which a microwave interactive construction is positioned. Herein the term "microwave interactive" is meant to refer to a material which becomes hot, upon exposure to microwave energy in a microwave oven.

During the popping operation, moisture inside the popcorn kernels absorbs microwave energy, generating sufficient steam and heat for popping and for expansion of bag 1. In addition, the microwave interactive material absorbs microwave energy and dissipates heat to the popcorn charge. In preferred constructions, the microwave interactive material occupies at least central region 13 and is in greater thermoconductive contact with that region than other portions of the popcorn package 1. That is, most of the microwave interactive material (by area or weight) is used in thermoconductive contact with the region wherein which it will be covered by the popcorn charge in use. This is preferred, since it leads to a preferred and efficient utilization of the microwave interactive material and also due to preferred heat transfer or heat retention characteristics in connection with the popcorn popping process. This technique is also used in conventional arrangements, such as many of those of the incorporated references.

Figure 5:
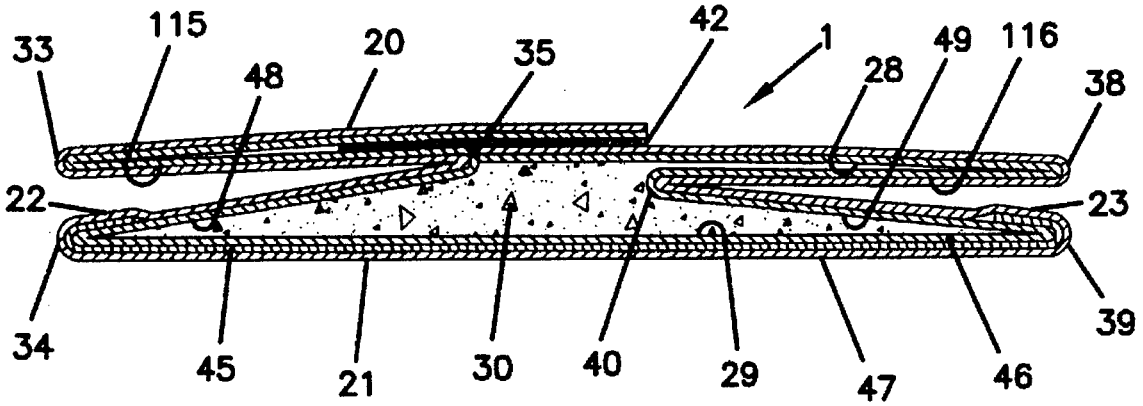
FIG. 5 is a cross-sectional view taken generally along line 5—5, FIG. 2.

Attention is now directed to FIG. 5, a cross-section taken generally along line 5—5, FIG. 2. From review of FIG. 5, it will be understood that the popcorn package 1 generally comprises a double-walled construction defining first and second opposite panels 20 and 21 joined by first and second opposite side gussets 22 and 23.

The gussets 22 and 23 generally separate popcorn package 1 into first and second expandable tubes 28 and 29. Popcorn charge 30 is substantially positioned and substantially retained within tube 29. Tube 28, prior to popping, is generally collapsed. Indeed, in preferred arrangements tube 28 is sealed closed by temporary heat seals, prior to popping.

Still referring to FIG. 5, side gusset 22 generally comprises edge folds 33 and 34 and inwardly directed central fold 35. Similarly, gusset 23 comprises edge folds 38 and 39 and inwardly directed central fold 40. Construction 1 for the arrangement shown in FIG. 5 is folded from a double-ply sheet of material, and panel 20 includes central longitudinal seam 42 therein. The folds 33, 34, 35, 38, 39 and 40 are widely used for flexible microwave packaging, for example they are shown in U.S. Pat. Nos. 5,044,777 and 5,195,829.

Underneath popcorn charge 30, arrangement 1 includes microwave interactive construction or susceptor 45. The microwave interactive construction or susceptor 45 may be of conventional design. In certain arrangements, such as the one shown in FIG. 5, it is positioned between layers or plies 46, 47 from which flexible construction 1 is folded. In some more recently designed systems, it can be a sheet of material secured to a single ply of material from which the flexible construction is folded. See, for example, U.S. Ser. No. 08/389,755, the disclosure of which is incorporated herein by reference. Either type of system (1-ply or multi-ply bag), may be used with the principles described herein.

Preferred microwave interactive constructions positionable in arrangements according to the present invention, are described hereinbelow.

Still referring to FIG. 5, according to the principles of the present invention, a releasable seal is used between the panel 21 (against which the popcorn charge 30 and microwave interactive construction 45 are positioned) and immediately adjacent panels 48 and 49 of the side gussets 22 and 23, respectively, to inhibit settling during a vertical storage. With respect to this, attention is directed to FIG. 4.

Figure 4:
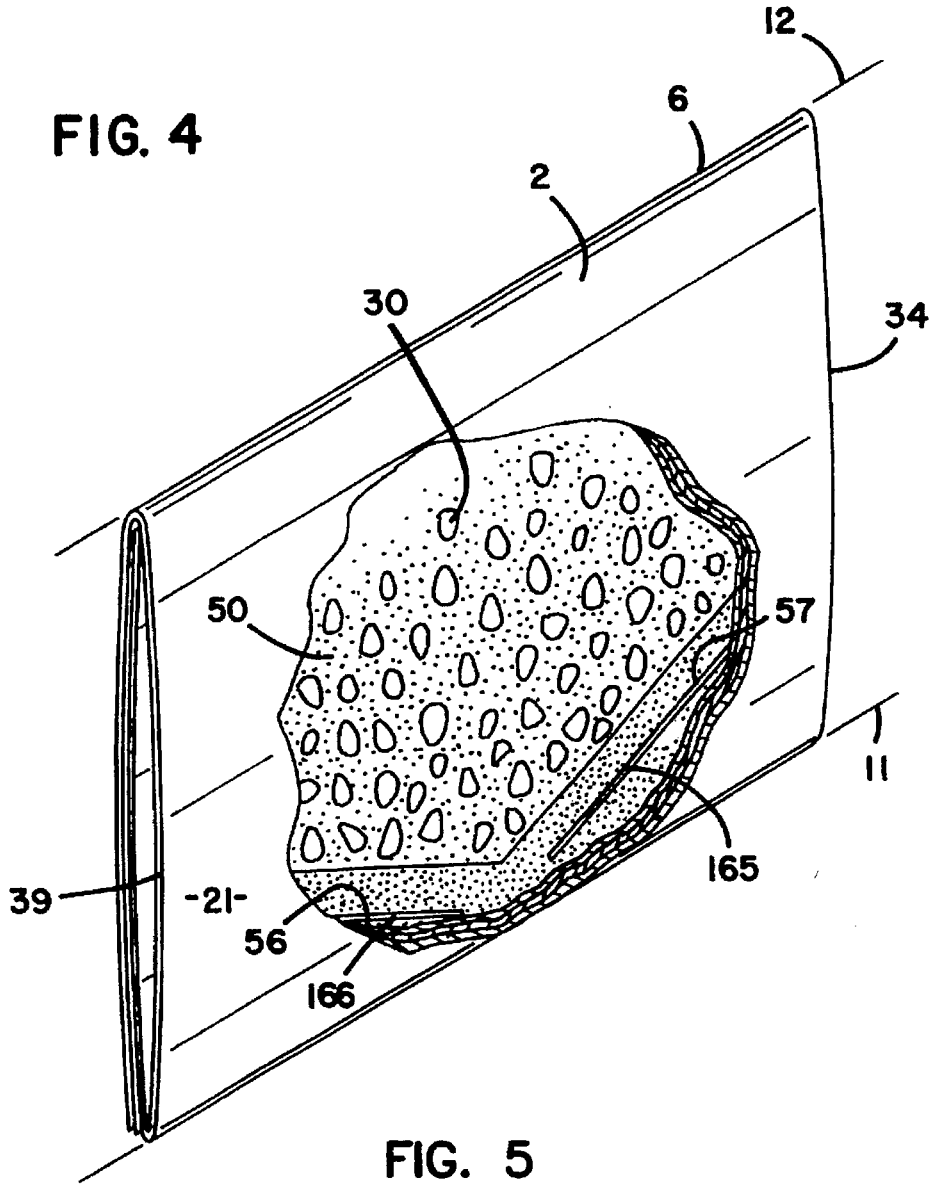
FIG. 4 is a front perspective view generally analogous to FIG. 1, with portions broken away to show internal detail and without the overwrap.

FIG. 4 is generally analogous to FIG. 1, but with portions broken away. In particular, popcorn charge 30 is viewable. In FIG. 4, the popcorn charge 30 is viewed from an orientation through panel 21, FIG. 5. Thus, the portion broken away in FIG. 4 is through both layers of panel 21 (i.e., layers 46 and 47), and also through microwave interactive construction 45. In FIG. 4, the popcorn charge 30 is shown including a mixture 50 of oil/fat and flavoring. Arrangements according to the present invention may be used with a variety of different popcorn charges, including, for example, ones that do not have added oil/fat associated with them.

Referring to FIG. 4, lines 56, 57 indicate the locations of seals between panels 48 and 49, and selected overlapping portions of panel 21, FIG. 5. When in the vertical orientation of FIG. 4, the popcorn charge 30 settles or shifts downwardly against the seal arrangement provided by/at regions 56, 57. Thus, settling (shifting) toward the bottom edge 5 is inhibited. The material from which seals 56, 57 are formed, is preferably such that it will readily release during the microwave cooking operation, and thus not inhibit the microwave popping operation. Preferred materials for generation of releasable seals in regions 56, 57 are described hereinbelow. Preferably the seals in regions 56, 57 are heat seals.

Figure 3:
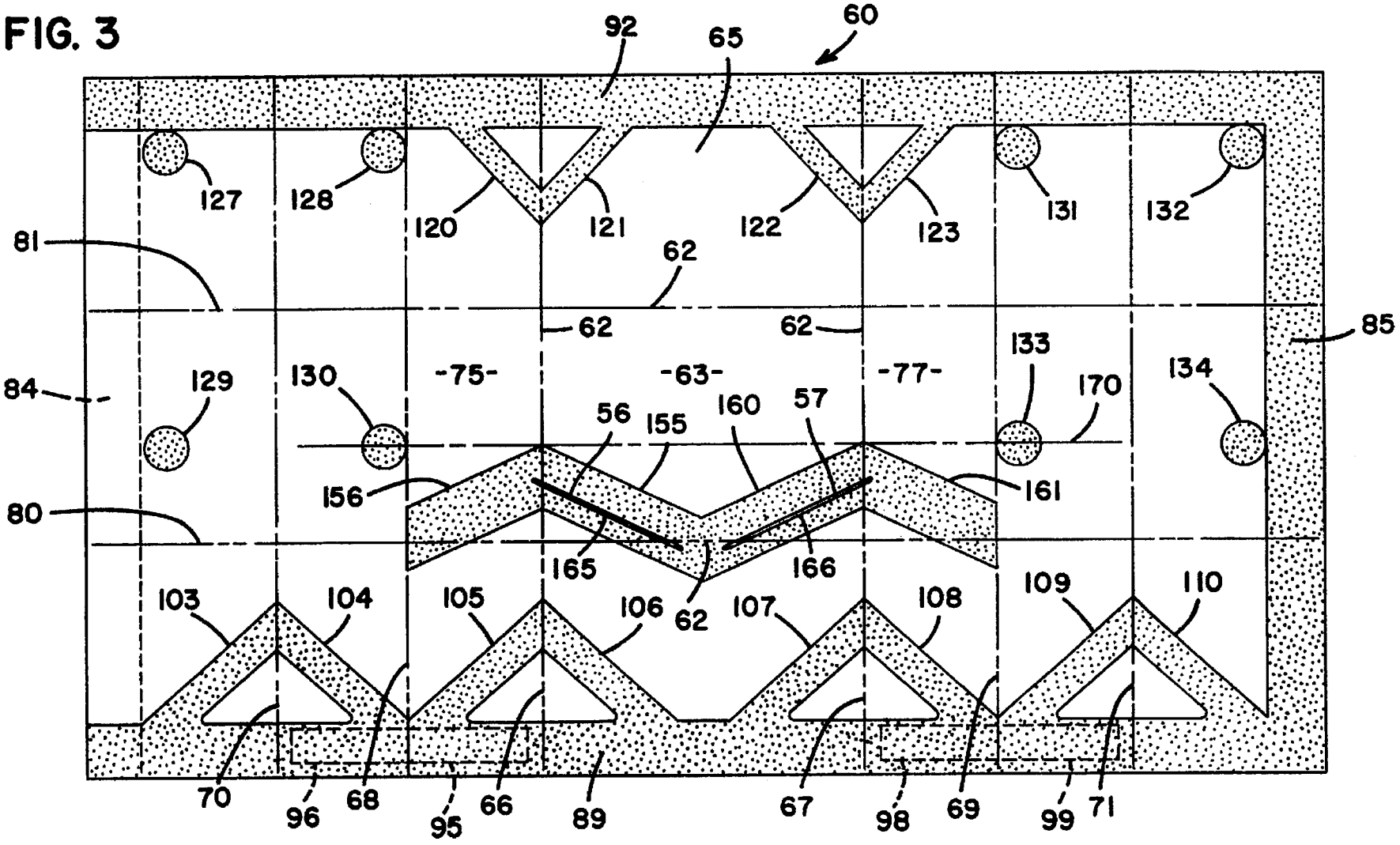
FIG. 3 is a top plan view of a sheet of flexible sheet material from which a bag arrangement such as that shown in FIGS. 1 and 2 can be folded; the arrangement of FIG. 3 including markings indicating where sealing material is preferably positioned on the construction.

Attention is now directed to FIG. 3. In FIG. 3, a top plan view of a panel or sheet 60 from which an arrangement according to FIGS. 1, 2, 4 and 5 can be folded, is shown. Many of the features illustrated in FIG. 3 are generally analogous to features shown or described in U.S. Pat. Nos. 5,195,829 and 5,044,777. Of course neither of these prior arrangements includes sealant fields as described herein that are oriented to inhibit settling/shifting during vertical storage, in a manner according to the present invention. These "new" sealant fields are, again, those generally indicated in FIG. 3 in the regions designated by reference numerals 56 and 57.

The view in FIG. 3 is of what is sometimes referred to as the "back side" of sheet 60; i.e., the side of sheet 60 which forms the interior surface of the assembled bag construction 1, FIG. 1. The side opposite the side viewable in FIG. 3 is sometimes referred to as the "front side", and will form the exterior surface of the bag construction 1.

Referring to FIG. 3, panel 60 comprises a sheet of flexible material from which arrangement 1 is folded and panel 60 includes various sealant fields thereon, to generate desired features.

Still referring to FIG. 3, line segments 62 define a region 63 within which, for preferred embodiments, most of the microwave interactive material, such as the microwave interactive material in construction 45, would be associated. The perimeter defined by lines 62 also indicates the location whereat the popcorn charge will eventually be positioned, in use. The microwave interactive construction, for example interactive construction 45, FIG. 5, may be positioned on an interior of the arrangement, an exterior, or between plys, as desired. In general, for preferred embodiments, microwave interactive construction 45 will be positioned either on an exterior surface of the package 1 (for 1-ply bag) or between plys (FIG. 5).

Referring to FIG. 3, again the surface 65 viewed is the surface which, when package 1 has been folded, forms the interior surface of the construction. The popcorn charge 30, then, will eventually be positioned over or against central region 63, defined by perimeter lines 62.

Still referring to FIG. 3, line 66 generally indicates where fold 34, FIG. 4, will be formed; and line 67 generally indicates where fold 39, FIG. 5, will be formed. Similarly, line 68 corresponds with fold 35 (FIG. 5), line 69 with fold 40 (FIG. 5), line 70 with fold 33 (FIG. 5) and line 71 with fold 38 (FIG. 5). Thus, region 75, between fold lines 68 and 66, will generally define panel 48, FIG. 5; and region 77 between fold lines 67 and 69 will generally define panel 49, FIG. 5

In general, opposite edges 5 and 6, (FIGS. 1 and 3) are eventually formed by folding the overall arrangement such that folds along lines 80 and 81, respectively, are created (FIG. 3). It will be understood that this later folding would generally be after the bag construction, FIG. 2, is at least partly assembled.

Still referring to FIG. 3, sealant field 84, positioned on underside panel 60, is used to engage field 85, during folding, to form the longitudinal seam or seal 42, FIG. 5. It will also be apparent that, during folding, various portions of field 89 will align with one another to form various portions of end seal 90, FIG. 2; and, various portions of field 92 (FIG. 3) will align with one another to form end seal 93, FIG. 2. Sealant fields 95 and 96, on the underside of panel 60, FIG.

3, will align with one another when folding around fold line 68 is conducted, to help secure panel 60 in a preferred configuration, after folding. This is analogous to what was done in the arrangement of U.S. Pat. No. 5,195,829, FIG. 1A, with sealant fields 82 and 84. Similarly, sealant fields 98 and 99, on an underside of panel 60, FIG. 3, align with one another when the panel is folded about fold line 69.

Attention is now directed toward sealant fields 103, 104, 105, 106, 107, 108, 109 and 110. Analogous fields were shown in U.S. Pat. No. 5,195,829, FIG. 1, at reference numerals 64–67. During folding, portions of fields 103–110 align with one another, to retain selected portions of the panel tacked to one another to provide for a preferred configuration during expansion. In particular, field 103 engages field 104; field 105 engages field 106; field 108 engages field 107; and field 110 engages field 109, during folding and heat application. Engagement between fields 105 and 106, and also 108 and 107, tends to retain selected portions of panels 48 and 49 against panel 21, FIG. 5, in regions where the popcorn charge is not located in the collapsed folded trifold 2 (FIG. 4). Sealing of field 103 against field 104, and field 110 against field 109, helps retain panels 115 and 116 sealed against panel 20, FIG. 5, in the collapsed trifold. This helps ensure that the popcorn charge 30, FIG. 5, is retained where desired in the arrangement. Advantages from this are described, in part, in U.S. Pat. No. 5,195,829.

Referring again to FIG. 3, attention is now directed to sealant fields 120, 121, 122, 123. When the arrangement is folded about fold line 66, sealant field 120 aligns with sealant field 121; and when the arrangement is folded about fold line 67, sealant field 123 aligns with sealant field 122. The engagement between fields 120 and 121 further ensures that panel 48 will be sealed against panel 21; and the engagement between fields 123 and 122 will further ensure that panel 49 is sealed against panel 21, in regions whereat the popcorn charge 30 is not positioned. This is similar to the utilization of fields 68, 70, 71 and 72, FIG. 1, of U.S. Pat. No. 5,195,829. Fields 105, 106, 107, 108, 120, 121, 122 and 123 help ensure that central section 63 will remain relatively flat, as the bag expands in use.

Attention is now directed to sealant fields 127, 128, 129, 130, 131, 132, 133 and 134. In the preferred embodiment shown, these are also used to ensure that panels 115 and 116 are sealed against panel 20, FIG. 5, so that the popcorn charge 30 is substantially retained in tube 29, and does not expand or spread substantially into tube 28 until desired during heating. In particular, fields 127 and 128 are oriented to engage one another, and fields 129 and 130 are oriented to engage one another, when the arrangement is folded about fold line 70; and, fields 131 and 132 oriented to engage one another, and fields 133 and 134 are oriented to engage one another, when the arrangement is folded about fold line 71. Similarly engagement between fields 103 and 104, and also between fields 109 and 110, ensure that tube 28 is maintained collapsed, until the popcorn expands.

Seals of the type associated with fields 127–134 have been used in previous constructions. See, for example, U.S. Pat. No. 5,044,777, FIG. 1, at 42, 44, 46, and 48.

As indicated previously, advantages according to the present invention result from the utilization of seals 56 and 57 in a preferred manner. Referring to FIG. 3, seal 56 comprises first and second sealant fields or regions 155 and 156; and seal 57 comprises sealant fields or regions 160 and 161. Region 155 is positioned over panel 63, and region 156 is oriented in a portion of panel 75 that will overlap field 155, when folding around fold line 66 occurs. Thus, when regions 165 and 156 comprise appropriate material, heat seal 165 can be formed using heat sealing jaws to secure panel 75 to region 66, in the portion of field regions 165 and 156 to which the heat sealing jaws are directly applied.

Similarly, field 160 is positioned on region 63, and field 161 is positioned in a portion of panel 77 which overlaps region 160, when folding about line 67 occurs. Again, a heat seal is then formed between regions 160 and 161, by a pair of heat sealer jaws used in an appropriate manner.

Regions 155 and 166, and also regions 160 and 161, are oriented to accommodate the desirable diagonal seal used to support the popcorn charge when the arrangement, FIG. 1, is oriented in a vertical manner (see FIG. 4). In FIG. 3, particular desired directions of extension for the two heat seals are shown at 165 and 166, respectively. Each preferably extends downwardly at an angle of about 15°–45°, and typically and more preferably about 25° from horizontal, when the arrangement is supported vertically as shown in FIG. 1. In FIG. 3, this is generally indicated by angles of about 25°, with respect to phantom line 170. Variations in this angle can be made, to accommodate a preferred positioning of a popcorn charge in a wide variety of arrangements. Sealant regions 156 and 160, 161 are preferably sized and configured for different angles and widths of the actual heat seals 165 and 166 to be selected.

It will be understood, then, that operation generally involves the use of the releasable seals 165 and 166 to support the popcorn from complete settling toward bottom edge 5, FIGS. 1 and 4, although some settling is permitted in the preferred embodiment by the gap or spacing between seals 165 and 166. In general, it is foreseen that heat seals such as seals 165 and 166 having a width of about 0.031 to 0.250 inch and typically about 0.062 inch, and a length of about 1.0 to 1.5 inches, will be sufficient for typical purposes. Heat seals 165 and 166 will preferably be formed from sealant material which will readily release as the bag expands and which comprise a material which will not provide any undesirable or unpleasant taste or aroma, or contamination of the food charge, during use. Preferred materials are described hereinbelow.

A Specific Example; Preferred Sealant Materials

From the following specific example and general characterizations of preferred materials, a wide variety of applications of the principles of the present invention will be understood.

Consider for example atypical popcorn product containing a charge of about 20–90 grams, typically about 72 grams of popcorn. The charge may be conventional and also contain oil/fat and/or flavorings. The charge may alternatively comprise an essentially added fat-free or oil-free arrangement, such as those described in U.S. Ser. Nos. 08/198,892; 08/391,437; and 08/397,481, the disclosures of which are incorporated herein by reference. Still other charges may be used.

For such an arrangement, panel 60, FIG. 3, would have a rectangular configuration with outer dimensions of about 12 inches by 21 inches. The various fold lines would be oriented such that region 63 defined by lines 62 would have an outer perimeter of about 4 inches by 5.5 inches.

The multi-ply laminate for panel 60 for a conventional arrangement, would generally comprise the following materials. The sheet of paper which forms the outer surface of the bag, when folded, would be a 23 lb blended Kraft paper (lb/ream). The sheet of paper which forms the innermost ply paper would be a 23 lb greaseproof paper. Both papers may be treated with a fluorochemical material, for grease resistance, typically 3M Fluorocarbon 807. Such materials are conventional. The laminating adhesive between the plys of paper, could be a typical conventional adhesive such as Duracet 12, available from Franklin International, Inc. of Columbus, Ohio; or H. B. Fuller WO-346022, H. B. Fuller, St. Paul, Minn. Other materials could also be used as the laminating adhesive.

The microwave susceptor arrangement would be positioned as described in U.S. Ser. No. 08/389,755. That is, it would be secured to the surface of panel 60 oriented opposite surface 65, i.e. positioned on an outer surface of construction 1, FIG. 5. The microwave interactive material would preferably comprise metallized polyester such as Hoechst Celanise polyester film (typically 48 gauge) vacuum metallized with aluminum to give a density of 0.25±0.05 as measured by a Tobias Densitometer. A company which can prepare such a material is Madico of Woebcan, Mass. 01888.

Sealant fields 84, 85, 89 and 90 would preferably comprise Duracet 12, (as with all Duracet 12 seals in the arrangement, applied in an amount of 4–7 lbs/ream) with each being about 0.937 inches wide.

The seal material in regions 103–110, 120–123, and 127–134 would preferably comprise Duracet 12. The preferred relative location, sizes and direction of extension of the sealant fields would be as shown in FIG. 3, modified for appropriate scale.

The material for sealant fields 95, 96, 98 and 99 would preferably be Duracet 12.

Releasable sealant material in seals 56, 57 would preferably be Duracet 12. As indicated above, the actual seals would be oriented, in the most preferred final product, to have a direction of extension of about 25° (i.e., 20°–30°) downwardly from horizontal line 170, FIG. 3. Such a heat seal could be readily formed from Duracet 12.

In general, for the preferred embodiment described, the same adhesive (Duracet 12) is utilized as the adhesive in all locations. For those seals which are to be released as the bag expands, typically the seal is formed with either relatively low pressure, by comparison to other locations, or with less surface area of contact between secured surfaces, or both. Conventional techniques to accomplish this may be used.

It is anticipated that arrangements according to the example could be readily formed in a continuous process, from a feed of sheet material or stock, having seal material appropriately applied thereto, such as through horizontal form/fill/seal methods or techniques. Convention folding equipment and equipment for positioning a popcorn charge within the arrangement, could be readily used.

It is foreseen that a preferred overwrap material will comprise 110 gauge–140 gauge biaxially oriented polypropylene.

What is claimed is:

1. A folded microwavable arrangement comprising:

(a) a folded bag having an interior including a first and second opposite panel joined by first and second opposite side gussets, the bag being folded to define a portion of the interior with an upper portion and a lower edge; said lower edge being defined by a transverse fold in said bag;

(b) a releasable seal arrangement in a portion of said folded bag between said upper portion and said lower edge; said releasable seal arrangement being oriented to inhibit contents in said interior from settling away from said upper portion and toward said lower fold line, when said folded bag is oriented with said upper portion oriented above said lower edge and with settable contents in said interior;

(c) said releasable seal arrangement including a first and second seal wherein:

(i) said first seal comprises a first adhesive region applied to said first opposite panel and said first side gusset, said first seal extending generally diagonally downwardly, when said arrangement is oriented with said upper portion above said lower edge;

(ii) said second seal comprises a second adhesive region applied to said first opposite panel and said second side gusset, said second seal extending generally diagonally downwardly, when said arrangement is oriented with said upper portion above said lower edge; and (iii) said first seal and said second seal extending diagonally downwardly toward one another, when said arrangement is oriented with said upper portion above said lower edge.

2. An arrangement according to claim 1 including:

(a) a microwave interactive construction in thermoconductive contact with at least said portion of the interior of the bag between said upper portion and said lower edge.

3. An arrangement according to claim 1 wherein:

(a) said first and second heat seals have a gap therebetween.

4. An arrangement according to claim 1 wherein:

(a) said folded bag comprises a trifold; and (b) said portion of said interior between said upper portion and said lower edge comprises a central portion of said trifold.

5. An arrangement according to claim 1 including:

(a) a charge of microwavable popcorn in said portion of the interior with the upper portion and the lower edge.

6. An arrangement according to claim 5 wherein:

(a) said charge of microwavable popcorn includes added oil/fat.

* * * * *

UNITED STATES PATENT AND TRADEMARK OFFICE

CERTIFICATE OF CORRECTION

PATENT NO. : 5,650,084

DATED : JULY 22, 1997

INVENTOR(S) : BLEY

It is certified that error appears in the above-identified patent and that said Letters Patent is hereby corrected as shown below:

Col. 8, line 1: "165" should read —155—

Col. 8, line 3: "165" should read —155—

Signed and Sealed this

Fifth Day of January, 1999

*Attest:*

*Attesting Officer*

*Acting Commissioner of Patents and Trademarks*